US011140945B2

(12) United States Patent
Laframboise et al.

(10) Patent No.: US 11,140,945 B2
(45) Date of Patent: Oct. 12, 2021

(54) LACES

(71) Applicant: CORRECT MOTION INC., Montréal (CA)

(72) Inventors: Steve Laframboise, Terrebonne (CA); John Moshopoulos, Laval (CA)

(73) Assignee: CORRECT MOTION INC., Montréal (CA)

( * ) Notice: Subject to any disclaimer, the term of this patent is extended or adjusted under 35 U.S.C. 154(b) by 0 days.

(21) Appl. No.: 16/500,586

(22) PCT Filed: Oct. 31, 2018

(86) PCT No.: PCT/CA2018/051386

§ 371 (c)(1),
(2) Date: Oct. 3, 2019

(87) PCT Pub. No.: WO2019/084688

PCT Pub. Date: May 9, 2019

(65) Prior Publication Data

US 2021/0112923 A1 Apr. 22, 2021

Related U.S. Application Data

(60) Provisional application No. 62/579,530, filed on Oct. 31, 2017, provisional application No. 62/690,372, (Continued)

(51) Int. Cl.

| | |
|---|---|
| ***A43C 1/02*** | (2006.01) |
| ***A43C 9/00*** | (2006.01) |
| ***A43C 1/00*** | (2006.01) |

(52) U.S. Cl.
CPC ..... *A43C 1/02* (2013.01); *A43C 1/00* (2013.01); *A43C 9/00* (2013.01)

(58) Field of Classification Search
CPC .... A43C 1/02; A43C 1/00; A43C 9/00; Y10T 24/3726; Y10T 24/3787; Y10T 24/37
See application file for complete search history.

(56) References Cited

U.S. PATENT DOCUMENTS

| | | | |
|---|---|---|---|
| 2,141,801 | A | 12/1938 | Taft |
| 2,477,151 | A | 7/1949 | Stapleton |

(Continued)

FOREIGN PATENT DOCUMENTS

| | | |
|---|---|---|
| CA | 2856284 | 1/2014 |
| CN | 2674906 | 2/2005 |

(Continued)

OTHER PUBLICATIONS

English Translation—Machine Generated of FR2971676(A1), "Lace for sports shoe, has tubular structure forming patterns having raised rings, where raised rings are leveled with eyelet of shoe, upon elongation of lace, for allowing passage of rings in eyelet shoe", published on Aug. 24, 2012.

(Continued)

*Primary Examiner* — Robert Sandy
(74) *Attorney, Agent, or Firm* — Bereskin & Parr LLP/S.E.N.C.R.L, s.r.l.

(57) ABSTRACT

A lace includes recesses, concave portions or cavities, effective for abutting against eyelets or hooks found in skates and effective to lock the laces at a given position when the lace is inserted into the eyelets or hooks.

21 Claims, 16 Drawing Sheets

Related U.S. Application Data filed on Jun. 27, 2018, provisional application No. 62/723,172, filed on Aug. 27, 2018.

(56) References Cited

U.S. PATENT DOCUMENTS

| | | | | |
|---|---|---|---|---|
| D406,692 | S | 3/1999 | Shin | |
| 5,920,970 | A | 7/1999 | Coblentz | |
| D424,964 | S | 5/2000 | Chia et al. | |
| 6,513,210 | B1 | 2/2003 | Gonzalez | |
| 7,448,197 | B2 | 11/2008 | Schwartz | |
| D604,941 | S | 12/2009 | Mouton | |
| D718,041 | S | 11/2014 | McAndrew | |
| 9,204,689 | B2 * | 12/2015 | Gonzalez | A43C 13/00 |
| D769,607 | S | 10/2016 | Martinson | |
| 9,675,137 | B2 | 6/2017 | Wu | |
| 10,165,831 | B2 * | 1/2019 | Tsai | A43C 9/02 |
| 2005/0217089 | A1 | 10/2005 | Lin | |
| 2014/0007392 | A1 | 1/2014 | Kajiwara et al. | |
| 2017/0065026 | A1 * | 3/2017 | Wu | A43C 1/02 |

FOREIGN PATENT DOCUMENTS

| | | |
|---|---|---|
| CN | 202680752 | 1/2013 |
| EP | 3424357 | 1/2019 |
| FR | 2971676 | 8/2012 |
| JP | 3173173 | 1/2012 |

OTHER PUBLICATIONS

English Translation—Machine Generated of CN202680752U, "Shoelaces with convex parts and concave parts", published on Jan. 23, 2013.

Delele, "2 Pair Round Wave Shape Non Slip Heavy Duty and Durable Outdoor Climbing Shoelaces Hiking Shoe Laces Shoestrings" published on Sep. 15, 2017.

Shoe Gear—36" Shoe Laces—Zig Zag—Pink, published on May 20, 2017.

English Abstract of CN201831051 (U), "Wing-type shoelace structure", published on May 18, 2011.

English Abstract of CN202112429 (U), "Spring type tying-free shoelace", published on Jan. 18, 2012.

English Abstract of EP1795085 (A1), "Extensible self-locking lace, in particular for manufacturing shoe laces", published on Jun. 13, 2007.

"Rakuten Global Market: New Balance Shoelaces running shoes wave processing shoe string replacement color: pink, size: f (114 cm)", published on Sep. 15, 2017.

Xtenex, "XTENEX Accu-Fit Compression Laces" published on Sep. 15, 2017.

English Translation—Machine Generated of CN2674906Y, "Loose-proof shoeslace", published on Feb. 2, 2005.

English Translation—Machine Generated of JP3173173U, published on Jan. 26, 2012.

* cited by examiner

LACES

CROSS-REFERENCE TO RELATED APPLICATIONS

The present application is a 35 USC 371 national stage entry of PCT/CA2018/051386 filed on Oct. 31, 2018 and which claims priority to U.S. application No. 62/579,530 filed on Oct. 31, 2017; U.S. application No. 62/690,372 filed on Jun. 27, 2018; and U.S. application No. 62/723,172 filed on Aug. 27, 2018. These documents are all hereby incorporated herein by reference in their entirety.

FIELD OF THE DISCLOSURE

The present disclosure relates to laces for footwear and for sport footwear.

BACKGROUND OF THE DISCLOSURE

Many laces designs exist but with many of them the user has to tie them very tightly in order to feel comfortable or to avoid them to eventually untie.

SUMMARY OF THE DISCLOSURE

It would thus be highly desirable to be provided with laces that would at least partially solve one of the problems previously mentioned or that would be an alternative to the existing technologies.

According to one aspect, there are provided laces comprising recesses, concave portions or cavities, effective for abutting against eyelets or hooks found in skates and effective to lock the laces at a given position when the laces are inserted into the eyelets or hooks.

According to another aspect, there are provided laces comprising recesses or concave portions or cavities effective, wherein said laces are not flat.

According to another aspect, there are provided laces as shown in any one of figures presented in this patent application.

According to another aspect, there is provided a method of tying sport footwear, comprising using the laces of the present disclosure and making a loop around hooks of the sport footwear.

According to one aspect, there is provided a lace, including:

- a structure of elastic material, the structure having at least two pairs of opposite sides;
- a first pair of opposite sides in which:
  - a first side of the first pair comprises alternating concave and convex portions;
  - a second side of the first pair comprises alternating concave and convex portions;
  - wherein the concave portions of the first side of the first pair match with the convex portions of the second side of the first pair along a longitudinal axis;
  - wherein the convex portions of the first side of the first pair match with the concave portions of the second side of the first pair along the longitudinal axis;
- a second pair of opposite sides in which:
  - a first side of the second pair comprises alternating concave and convex portions;
  - a second side of the second pair comprises alternating concave and convex portions;

- wherein the concave portions of the first side of the second pair match with the concave portions of the second side of the second pair along the longitudinal axis; and
  - wherein the convex portions of the first side of the second pair match with the convex portions of the second side of the second pair along the longitudinal axis.

BRIEF DESCRIPTION OF THE DRAWINGS

The following drawings represent examples that are presented in a non-limitative manner.

DETAILED DESCRIPTION OF THE DISCLOSURE

The following examples are presented in a non-limitative manner.

Terms of degree such as "about" and "approximately" as used herein mean a reasonable amount of deviation of the modified term such that the end result is not significantly changed. These terms of degree should be construed as including a deviation of at least ±5% or at least ±10% of the modified term if this deviation would not negate the meaning of the word it modifies.

This technology relates to laces that can be used for various footwear.

For example, the laces can be used for skates such as ice hockey skates or figure skating skates. The laces can also be used with running shoes or any sport shoes.

These laces are significantly different from conventional laces used for skates. Generally, conventional laces are flat.

As can be seen in FIGS. 1-8, laces that have recesses are defined therein. These recesses or concave portions or cavities are useful to abut against eyelets or hooks found in skates and are useful to lock the laces at such a given position.

Figure 1:
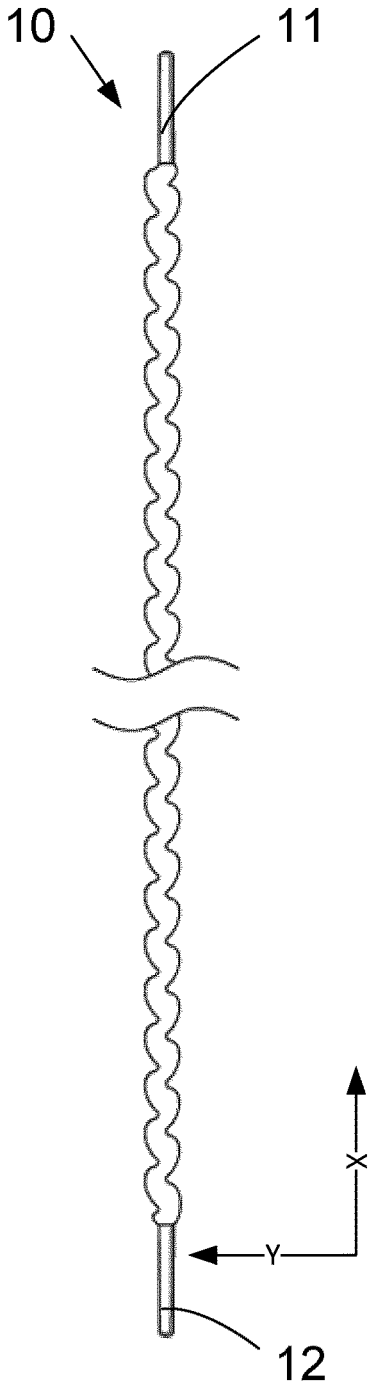
FIG. 1 is a right side view of the LACE according to the first embodiment.
Figure 2:
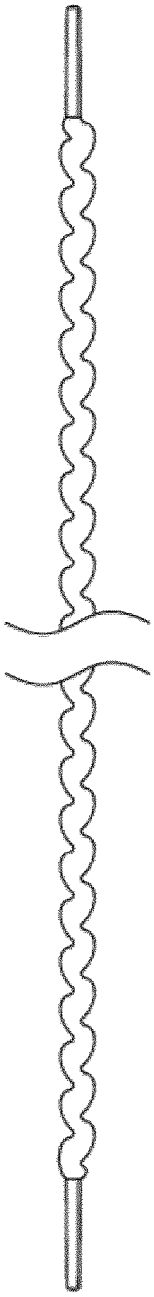
FIG. 2 is a left side view of the LACE according to the first embodiment.
Figure 3:
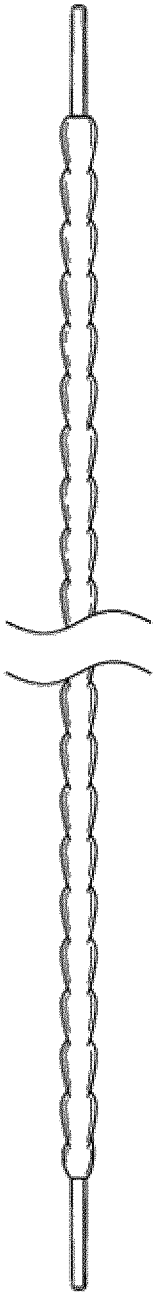
FIG. 3 is a top view of the LACE according to the first embodiment.
Figure 4:
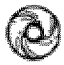
FIG. 4 is a rear view of the LACE according to the first embodiment.
Figure 5:
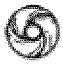
FIG. 5 is a front view of the LACE according to the first embodiment.
Figure 6:
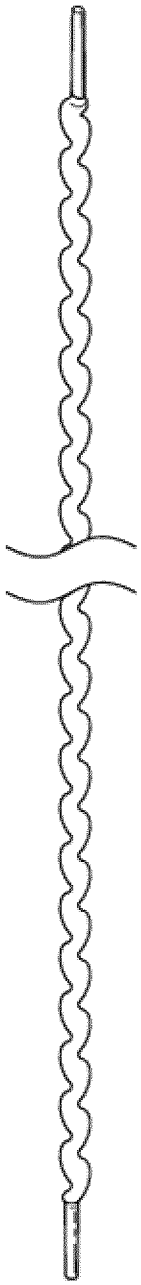
FIG. 6 is a right side view of the LACE according to the second embodiment.
Figure 7:
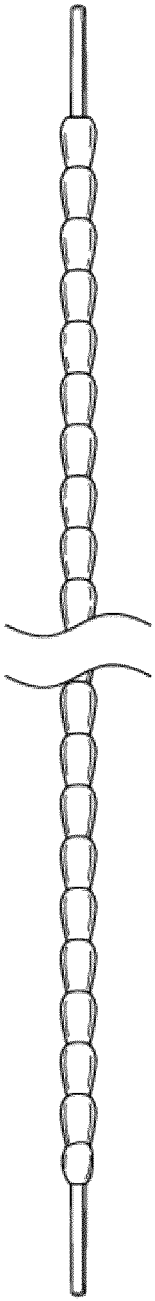
FIG. 7 is a top view of the LACE according to the second embodiment.
Figure 8:
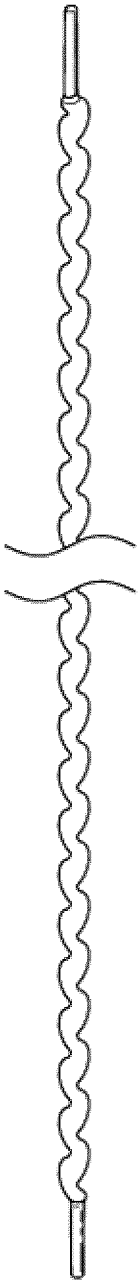
FIG. 8 is a left side view of the LACE according to the second embodiment.

Referring to FIG. 1, there is shown a lace 10 according to one embodiment. The lace has a pair of ends 11 and 12. Between the ends 11 and 12, the lace 10 has a structure defining a series of alternating convex shaped portions and concave shaped portions along a longitudinal axis of the structure, The longitudinal axis can be the axis X.

For example, peaks of the convex shaped portions can be aligned with troughs of the corresponding concave shaped portions, such that the lace can define cavities abutting against eyelets or hooks found in skates and effectively lock at a given position when the lace is positioned into the eyelets or hooks.

Figure 9A:
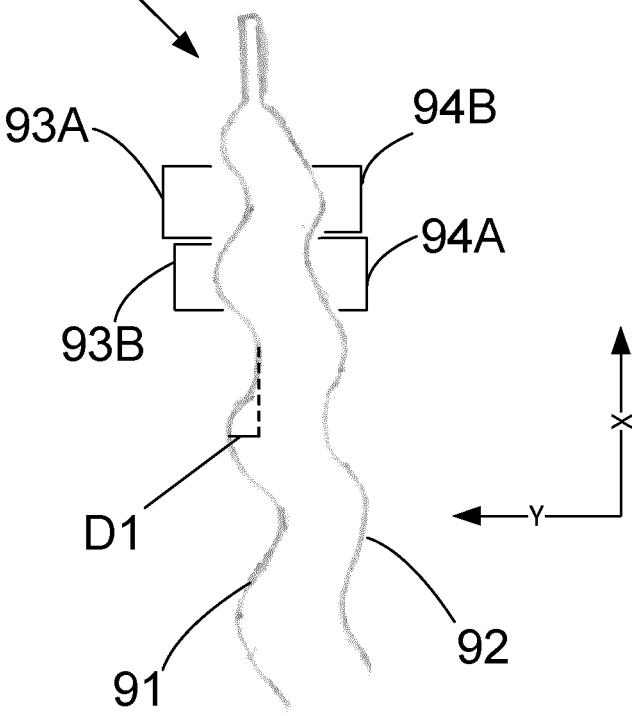
FIGS. 9A and 9B show a cross section of a lace having two pairs of opposite sides, according to one embodiment.
Figure 9B:
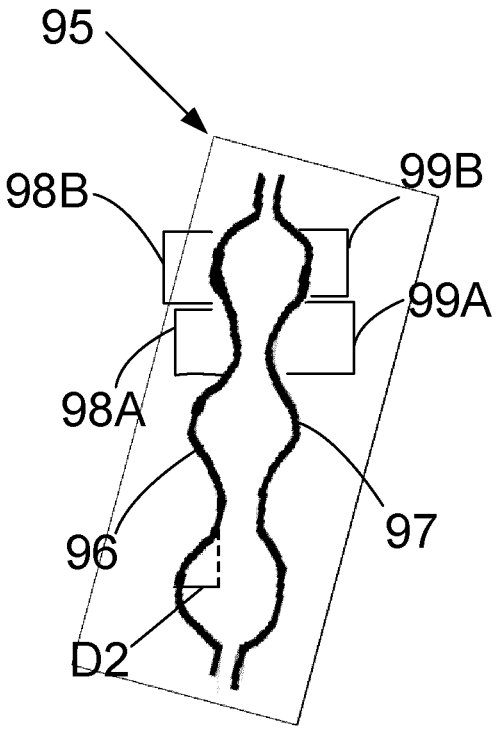

The lace can have a structure with at least two pairs of opposite sides. Referring to FIGS. 9A and 9B, there is shown a lace having two pairs of opposite sides. The lace can be made of an elastic material. The elastic material can be braided. The two pairs of opposite sides can be a single unitary continuous piece.

Figure 9C:
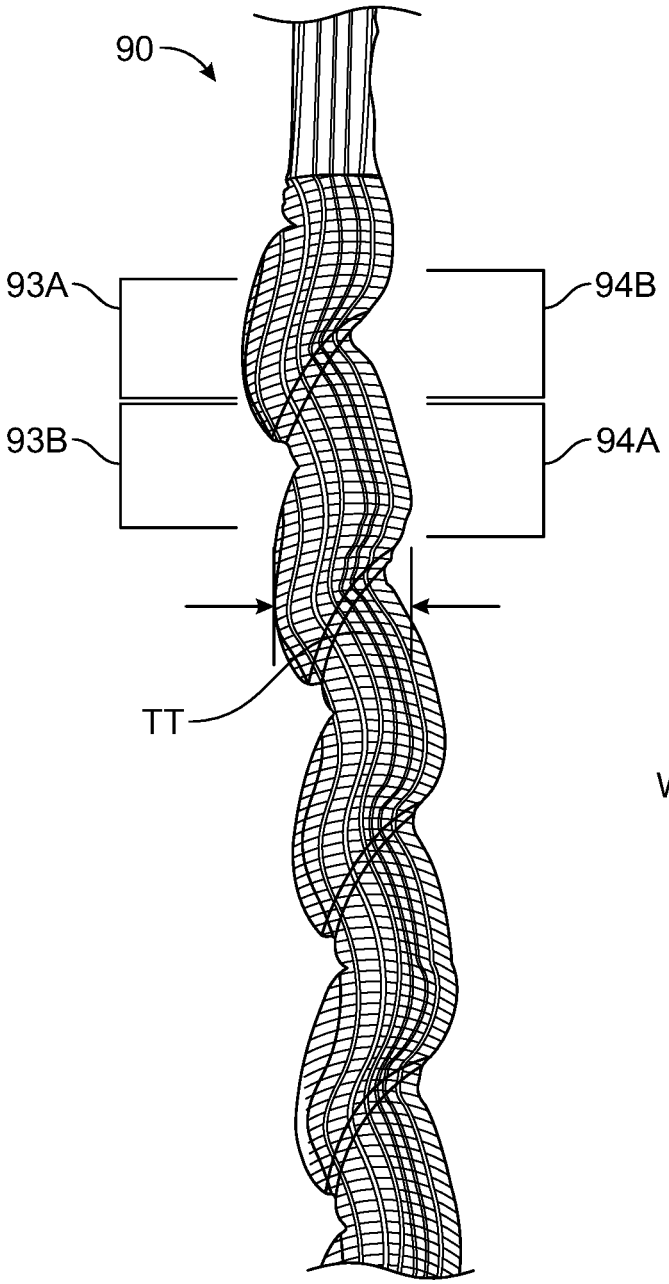
FIGS. 9C and 9D shows a perspective view of the lace of FIGS. 9A and 9B.
Figure 9D:
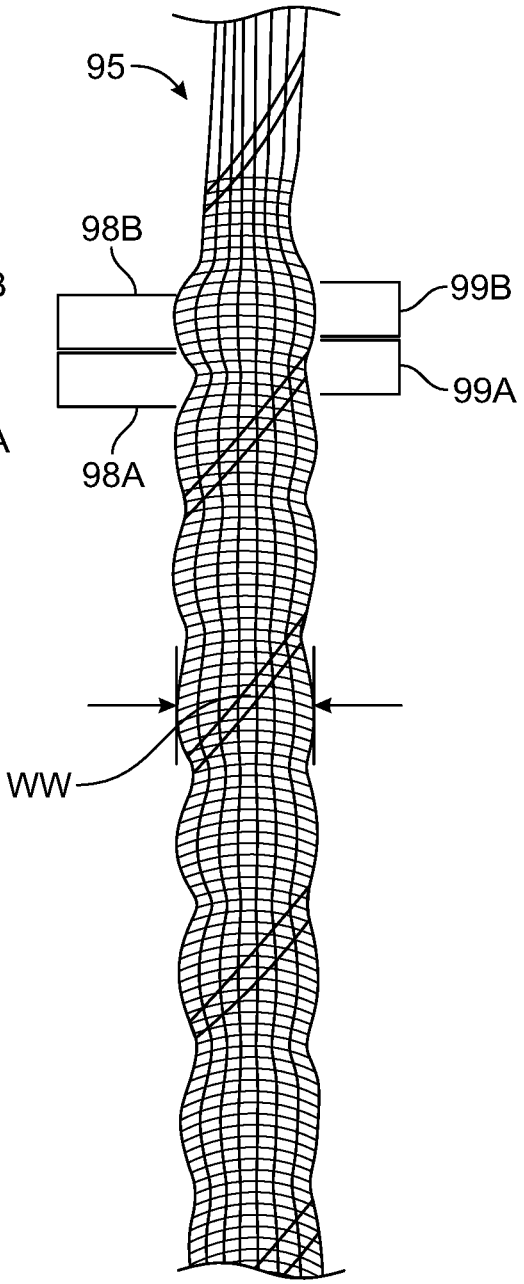

FIGS. 9A and 9C show the first pair 90 of opposed sides 91 and 92. FIGS. 9B and 9D shows the second pair 95 of opposed sides 96 and 97.

As shown in FIG. 9A, the first side 91 of the first pair 90 has alternating concave portions 93A and convex 93B portions. The second side 92 of the first pair 90 includes alternating concave portions 94A and convex portions 94B. The concave portions 93A of the first side 91 of the first pair 90 match with the convex portions 94B of the second side 92 of the first pair 90 along the longitudinal axis X. The convex portions 93B of the first side 91 of the first pair 90 match with the concave portions 94A of the second side 92 of the first pair 90 along the longitudinal axis X.

As shown in FIG. 9B, the first side 96 of the second pair 95 comprises alternating concave portions 98A and convex portions 98B. The second side 97 of the second pair 95 comprises alternating concave portions 99A and convex portions 99B. The concave portions 98A of the first side 96 of the second pair 95 match with the concave portions 99A of the second side 97 of the second pair 95 along the longitudinal axis X. The convex portions 98B of the first side 96 of the second pair 95 match with the convex portions 99B of the second side 97 of the second pair 95 along the longitudinal axis X.

Cavities formed by the pairs of opposite sides are effective for abutting against eyelets or hooks found in skates and effective to lock the lace at a given position when the lace is inserted into the eyelets or hooks. For example, an outer surface of convex portions 93B and 94B of the lace shown in FIG. 9A and an outer surface of convex portions 98B and 99B of the lace shown in FIG. 9A can provide a surface for abutting against at least a portion of an eyelet and/or a hook found in skates. For example, an outer surface of convex portions 93B and 94B of the lace shown in FIG. 9A and an outer surface of convex portions 98B and 99B of the lace shown in FIG. 9A can provide a surface for abutting against at least a portion of an eyelet and/or a hook found in skates when the lace passes through the eyelet or around a hook of a skate.

For example, the first pair of opposed sides can be substantially orthogonal to the second pair of opposed sides.

For example, a distance between a peak of the convex portions and a trough of the concave portions of the first pair is greater than the distance between a peak of the convex portions and a trough of the concave portions of the second pair. Referring to FIGS. 9A and 9B, D1 is the distance between a convex portion peak and a concave portion trough on the first side 91 of the first pair 90 of opposed sides; D2 is the distance between a convex portion peak and a concave portion trough on the first side 96 of the second pair 95 of opposed sides. For example, D1 can be greater than D2. For example, D1 can be two times greater than D2. For example, D1 can be three times greater than D2.

Herein, the terms "thickness" and "width" each refer to measurements between two most distant points on an axis that is orthogonal to an axis that is defined by the lace and extending along a length of the lace, where "thickness" and "width" are measured on axes that are also orthogonal to each other. Examples of the thickness TT and the width WW are shown in FIGS. 9C and 9D.

In some examples, the width of the lace can be greater than the thickness of the lace. In these examples, the lace may be known as a "flat lace".

In some examples, the thickness of the lace can be greater than the width of the lace. In these examples, the lace may be known as a "flat lace".

In some examples, the width of the lace as measured along one axis that is orthogonal to the axis defined by the lace can be about the same as the thickness of the lace as measured along one axis that is orthogonal to the axis defined by the lace and orthogonal to the axis along which the width is measured. In these examples, the distances between two furthest points as measured along two axes (i.e. the axis along which the width is measured and the axis along which the thickness is measured) that are each orthogonal to the axis defined by the lace have the same length. In these examples, the lace may be known as a "rounded lace".

In some other examples, there are at least two axes that are orthogonal to the axis that is defined by the lace and extending along a length of the lace. In these examples, the lace may be known as a "rounded lace". For example, measurements of distance between two most distant points on each axis that is orthogonal to the axis defined by the lace can have the same value, In some other examples, there are a plurality of axes that are orthogonal to the axis that is defined by the lace and extending along a length of the lace. In these examples, the lace may be known as a "rounded lace". For example, measurements of distance between two most distant points on each axis that is orthogonal to the axis defined by the lace can have the same value, In some examples, the distances between two furthest points as measured along any axis that is orthogonal to the axis defined by the lace has the same length. In these examples, the lace may be known as a "round lace".

For example, the lace can have a thickness of about 2 mm to about 7 mm or about 3 mm or about 7 mm. For example, the lace can have a thickness of about 3 mm to about 6 mm. For example, the lace can have a thickness of about 3.5 mm to about 5 mm. For example, the lace can have a thickness of about 3.6 mm to about 4 mm. For example, the lace can have a thickness of about 4.2 mm to about 4.8 mm. For example, the lace can have a thickness of about 5.2 mm to about 5.8 mm. For example, the lace can have a thickness of about 3.8 mm. For example, the lace can have a thickness of about 4.5 mm. For example, the lace can have a thickness of about 5.5 mm.

For example, the lace can have a width about 2 mm to about 7 mm, about 3 mm to about 6 mm, about 3.5 mm to about 5 mm, about 3.6 mm to about 4 mm, or about 4.2 mm to about 4.8 mm. For example, the lace can have a width of about 3.8 mm. For example, the lace can have a width of about 4.5 mm.

For example, the lace has a drape stiffness of about 5.8 cm to about 6.6 cm in accordance with FTMS 191A Method 5206. For example, the lace has a drape stiffness of about 5.9 cm to about 6.5 cm in accordance with FTMS 191A Method 5206. For example, the lace has a drape stiffness of about 6.0 cm to about 6.4 cm in accordance with FTMS 191A Method 5206. For example, the lace has a drape stiffness of about 6.0 cm to about 6.3 cm in accordance with FTMS 191A Method 5206. For example, the lace has a drape stiffness of about 6.1 cm to about 6.2 cm in accordance with FTMS 191A Method 5206.

For example, the lace has a tex yarn (mass in grams of 1000 m of yarn) of about 7 000 tex to 14 000 tex in accordance with CAN/CGSB-4.2 No 5.2-M87 (2013) standard. For example, the lace has a tex yarn of about 8 000 tex to about 13 000 tex in accordance with CAN/CGSB-4.2 No 5.2-M87 (2013) standard. For example, the lace has a tex yarn of about 7 000 tex to about 9 000 tex in accordance with CAN/CGSB-4.2 No 5.2-M87 (2013) standard. For example, the lace has a tex yarn of about 11 000 tex to about 13 000 tex in accordance with CAN/CGSB-4.2 No 5.2-M87 (2013) standard.

For example, the lace has a denier yarn (mass in grams of 900 m of yarn) of about 60 000 denier to about 130 000 denier in accordance with CAN/CGSB-4.2 No 5.2-M87 (2013) standard. For example, the lace has a denier yarn of about 70 000 denier to about 110 000 denier in accordance with CAN/CGSB-4.2 No 5.2-M87 (2013) standard. For example, the lace has a denier yarn of about 75 000 denier to about 80 000 denier in accordance with CAN/CGSB-4.2 No 5.2-M87 (2013) standard. For example, the lace has a denier yarn of about 110 000 denier to about 130 000 denier in accordance with CAN/CGSB-4.2 No 5.2-M87 (2013) standard.

For example, a force of at least 5 N, at least 7.5 N, at least 10 N, at least 15 N or at least 20 N can be necessary to disengage the lace from an eyelet of a hockey skate and slide the lace therethrough.

For example, a force of about 5 to about 25 N, about 5 to about 20 N, about 5 to about 15 N, about 10 to about 25 N, about 10 N to about 20 N or about 15 to about 25 N can be necessary to disengage the lace from an eyelet of a hockey skate and slide the lace therethrough.

For example, a force at least 100%, at least 200%, at least 300% or at least 400% greater than a force to disengage a standard lace is necessary to disengage the lace from an eyelet of a hockey skate and slide the lace therethrough.

For example, a force of about 100% to about 400%, about 100% to about 300%, about 200% to about 400%, about 200% to about 300%, about 250% to about 400% or about 300% to about 400%, greater than a force to disengage a standard lace is necessary to disengage the lace from an eyelet of a hockey skate and slide the lace therethrough.

For example, the force necessary to disengage the lace from an eyelet of a hockey skate and slide the lace therethrough can be a vertical force.

For example, a force of at least 2.5 N, at least 3 N, at least 3.5 N, at least 4 N or at least 5 N can be necessary to disengage the lace from an eyelet of an artistic skate and slide the lace therethrough.

For example, a force of about 2.5 N to about 10 N, about 2.5 N to about 7 N, about 4 N to about 10 N, about 3 N to about 8 N, about 4 N to about 8 N or about 4 to about 7 N can be necessary to disengage the lace from an eyelet of an artistic skate and slide the lace therethrough.

For example, a force at least 100%, at least 200%, at least 300% or at least 400% greater than a force to disengage a standard lace is necessary to disengage the lace from an eyelet of an artistic skate and slide the lace therethrough.

For example, a force of about 100% to about 400%, about 100% to about 300%, about 200% to about 400%, about 200% to about 300%, about 150% to about 300% or about 150% to about 250%, greater than a force to disengage a standard lace is necessary to disengage the lace from an eyelet of a hockey skate and slide the lace therethrough.

For example, the force necessary to disengage the lace from an eyelet of an artistic skate and slide the lace therethrough can be a vertical force.

For example, the lace can be used in combination with a skate having eyelets with a diameter in a range of about 2 mm to about 8 mm, about 3 mm to about 6 mm, about 2.5 mm to about 3.5 mm, or about 5.5 mm to about 6.5 mm. For example, the lace can be used in combination with a skate having eyelets with a diameter of about 3.0 mm. For example, the lace can be used in combination with a skate having eyelets with a diameter of about 6.0 mm.

For example, the lace thickness and the lace width can be equal.

For example, the lace can be a rounded lace.

For example, the lace can comprise a polymer coating.

For example, the lace can comprise a polyester coating.

For example, the lace can be made by a crimping process.

For example, there is provided a kit comprising at least two laces as defined in the present disclosure.

For example, there is provided a kit comprising at least two laces as defined in the present disclosure and a sport footwear.

For example, there is provided a kit comprising at least two laces as defined in the present disclosure and a pair of sport footwear.

Figure 10:
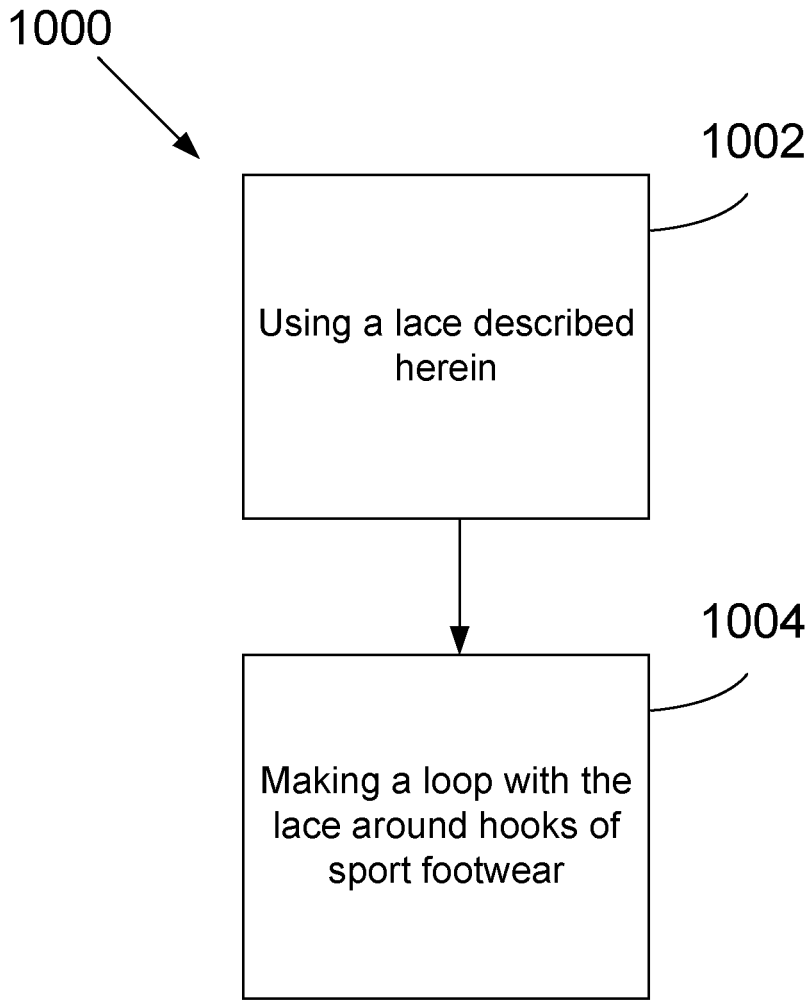
FIG. 10 is a block diagram of a method of tying sport footwear, according to one embodiment.

A method of tying sport footwear is also disclosed herein. The method 1000, as shown in FIG. 10, includes a first step 1002 of using a lace of at least one of the embodiments described herein and a second step 1004 of making a loop with the lace around hooks of sport footwear. The sport footwear may be a skate, such as but not limited to a figure skate (e.g. artistic skate) or a hockey skate.

Table 1 shows the results of a linear density test performed on an exemplary embodiment of the lace having a thickness of 5.5 mm. Table 2 shows the results of a stiffness of cloth test, and drape and flex test performed (cantilever bending method) on the same exemplary embodiment of the lace.

TABLE 1

| | | | | |
|---|---|---|---|---|
| IDENTIFICATION: | One zig-zag lace: Black, Big | | | |
| STANDARD: | | | | |
| TEST: | Linear density of Yarn | CAN/CGSB-4.2 N° 5.2-M87 (2013) | | |
| TEST CONDITIONS: | Conditioning atmosphere: 21° C., 65% R.H.<br>Length used (mm) - Yarn #1: 2498 | | | |
| RESULTS: | Individual Data | Avg. | S.D. | % CV |
| Identification of yarn #1: | * | | | |
| Tex - Yarn #1: | 12810.2 | | | |
| c.c. - Yarn #1: | 0.0 | | | |
| Denier - Yarn #1: | 115292.2 | | | |

REMARKS: *Total length, lace tip included.

TABLE 2

| | | | | | |
|---|---|---|---|---|---|
| IDENTIFICATION: | One zig-zag lace: Black, Big | | | | |
| STANDARD: | | | | | |
| TEST: | Stiffness of Cloth, Drape and Flex: Cantilever Bending Method | | | FTMS 191A Method 5206<br>Jul. 20, 1978‡ | |
| TEST CONDITIONS: | Conditioning atmosphere: 21° C., 65% R.H.:<br>Apparatus used: Stiffness Tester. | | | | |
| RESULTS: | Individual Data | | Avg. | S.D. | % CV |
| 1-LENGTH DIRECTION: | . | | | | |
| | . | | | | |
| | . | | | | |
| 1-Drape Stiffness (cm): | 6.15 | 6.25 | 6.20 | 0.07 | 1.1 |

REMARKS: Measurements taken at each end, including lace tip.

Table 3 shows the results of a linear density test performed on another exemplary embodiment of the lace having a thickness of 3.8 mm. Table 4 shows the results of a stiffness of cloth test, and drape and flex test performed (cantilever bending method) on that same another exemplary embodiment of the lace.

TABLE 3

| | | | | |
|---|---|---|---|---|
| IDENTIFICATION: | One zig-zag lace: Black, Medium | | | |
| STANDARD: | | | | |
| TEST: | Linear density of Yarn | CAN/CGSB-4.2 N° 5.2-M87 (2013) | | |
| TEST CONDITIONS: | Conditioning atmosphere: 21° C., 65% R.H.<br>Length used (mm) - Yarn #1: 3056 | | | |
| RESULTS: | Individual Data | Avg. | S.D. | % CV |
| Identification of yarn #1: | * | | | |
| Tex - Yarn #1: | 8475.1 | | | |
| c.c. - Yarn #1: | 0.1 | | | |
| Denier - Yarn #1: | 76276.2 | | | |

REMARKS: *Total length. lace tip included.

TABLE 4

| | | |
|---|---|---|
| IDENTIFICATION: | One zig-zag lace: Black, Medium | |
| STANDARD: | | |
| TEST: | Stiffness of Cloth, Drape and Flex; Cantilever Bending Method | FTMS 191A Metod 5206 |

TABLE 4-continued

| TEST CONDITIONS: Conditioning atmosphere: 21° C., 65% R.H.: Apparent used: Stiffness Tester | | | | Jul. 20, 1978‡ | |
|---|---|---|---|---|---|
| RESULTS: | Individual Data | | Avg. | S.D. | % CV |
| 1-LENGTH DIRECTION | . . . | | | | |
| 1-Drape Stiffness (cm): | 6.00 | 6.15 | 6.08 | 0.11 | 1.7 |

REMARKS: Measurements taken at each end, including lace tip.

When a user having conventional laces is trying to bind them and tight them, if the user releases the laces, they automatically undo or untie. The user has to hold them at any moment before tying otherwise the conventional laces loosen.

With the laces of the present disclosure, by simply inserting the laces into one of the eyelets or hooks of the skate into one of the recesses or cavities, it will lock the lace into the eyelet or hook, thereby maintaining the laces in place. That is very useful for maintaining the laces in place when a user is trying to bind them or simply once the skate lace bow is made in order to maintain the skate tightly attached.

Figure 11:
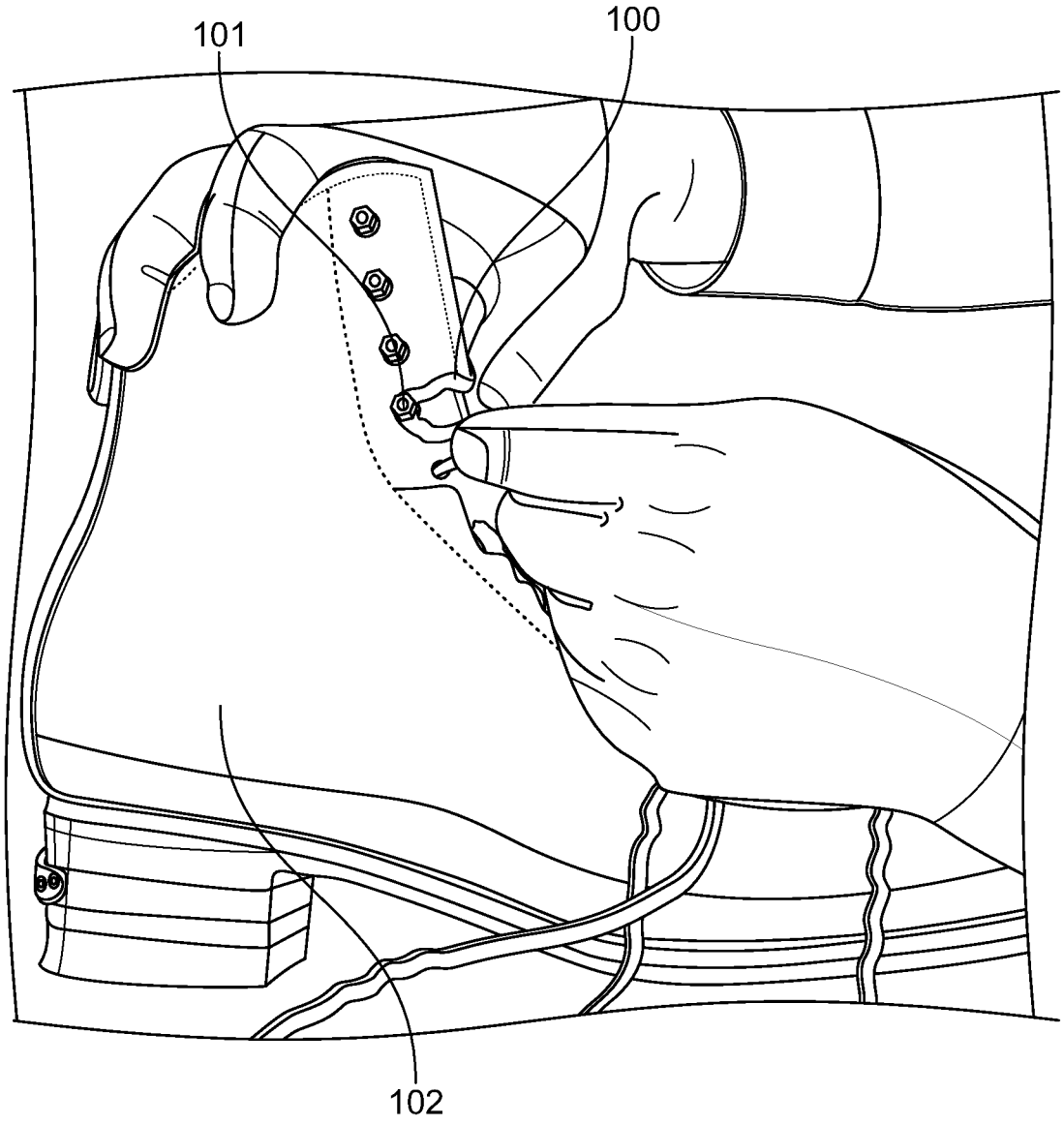
FIGS. 11, 12 and 13 show a perspective view of the lace secured into hooks of a skate shoe, according to embodiments.

Referring to FIG. 11, there is shown a perspective view of a lace 100 secured into eyelets of a skate shoe 102. For example, the lace can have a structure formed with alternating convex and concave shaped portions. The portions of the lace are effective for abutting against the eyelets of the skate shoe and effective to lock the lace at a given position when the lace is inserted into the eyelets. For example, the narrow and curved part of the lace is effective for locking the lace inside the eyelets. This way, the user does not have to hold the laces tight when trying to tie the skate.

On FIG. 11, the lace 100 is secured into hooks of the skate shoe. The lace is bent at an angle to embrace the hook 101, such that the convex and concave portions of the lace 100 are effective for abutting against the hook 101 of the skate shoe 102 and effective to lock the lace at a given position on the hook 101.

Figure 12:
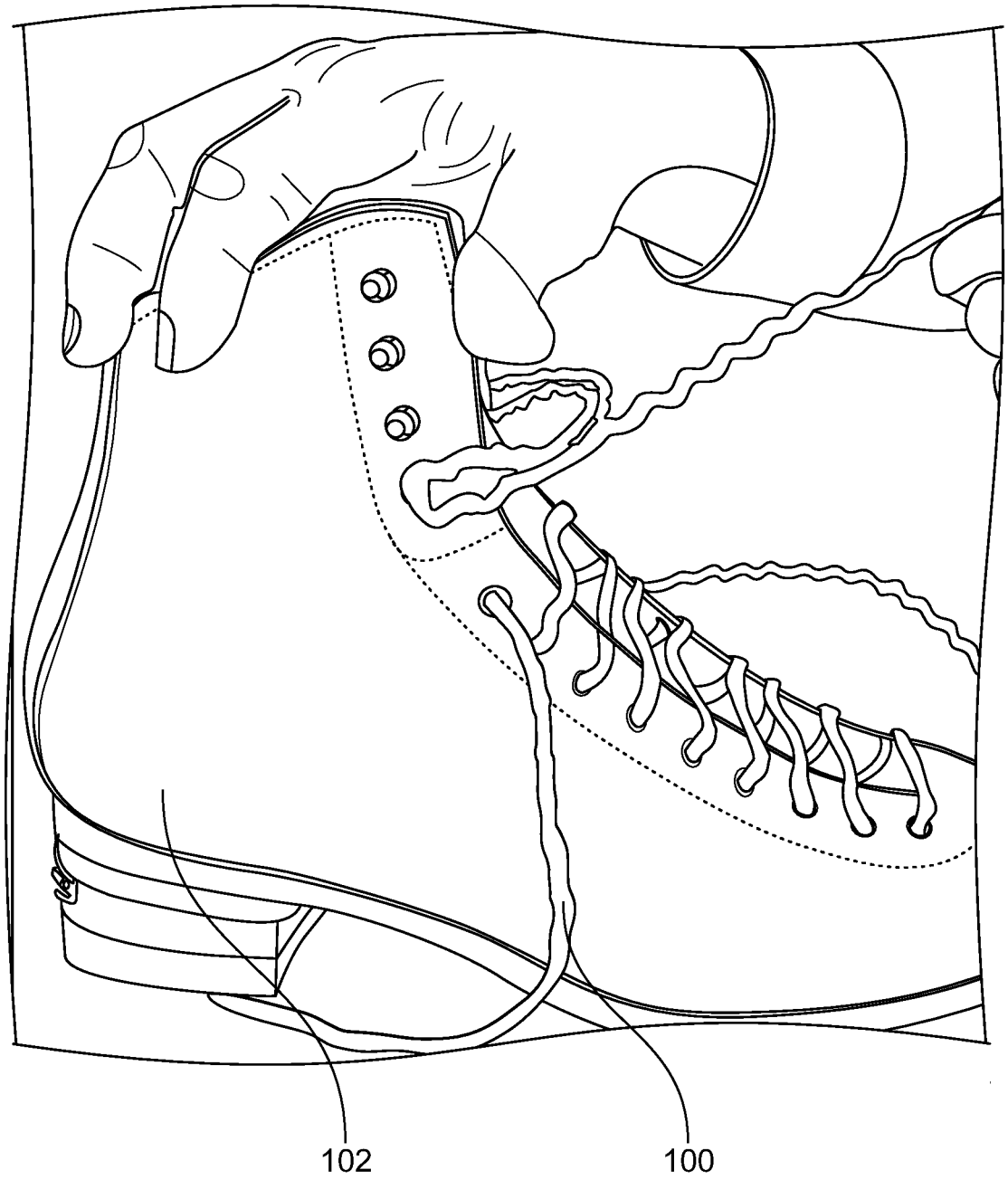

Referring to FIG. 12, there is shown a perspective view of a lace 100 secured into eyelets of a skate shoe 102. For example, the lace can have a structure formed with alternating convex and concave shaped portions. The portions of the lace are effective for abutting against the eyelets of the skate shoe and effective to lock the lace at a given position when the lace is inserted into the eyelets. For example, the narrow and curved part of the lace is effective for locking the lace inside the eyelets.

As shown in FIG. 12, once the lace is locked in the hook 101, the lace is able to hold its own form and weight against the hook. For example, the hook can be secured on concave and convex portions of the lace, which embraces the surface of the hook.

Figure 13:
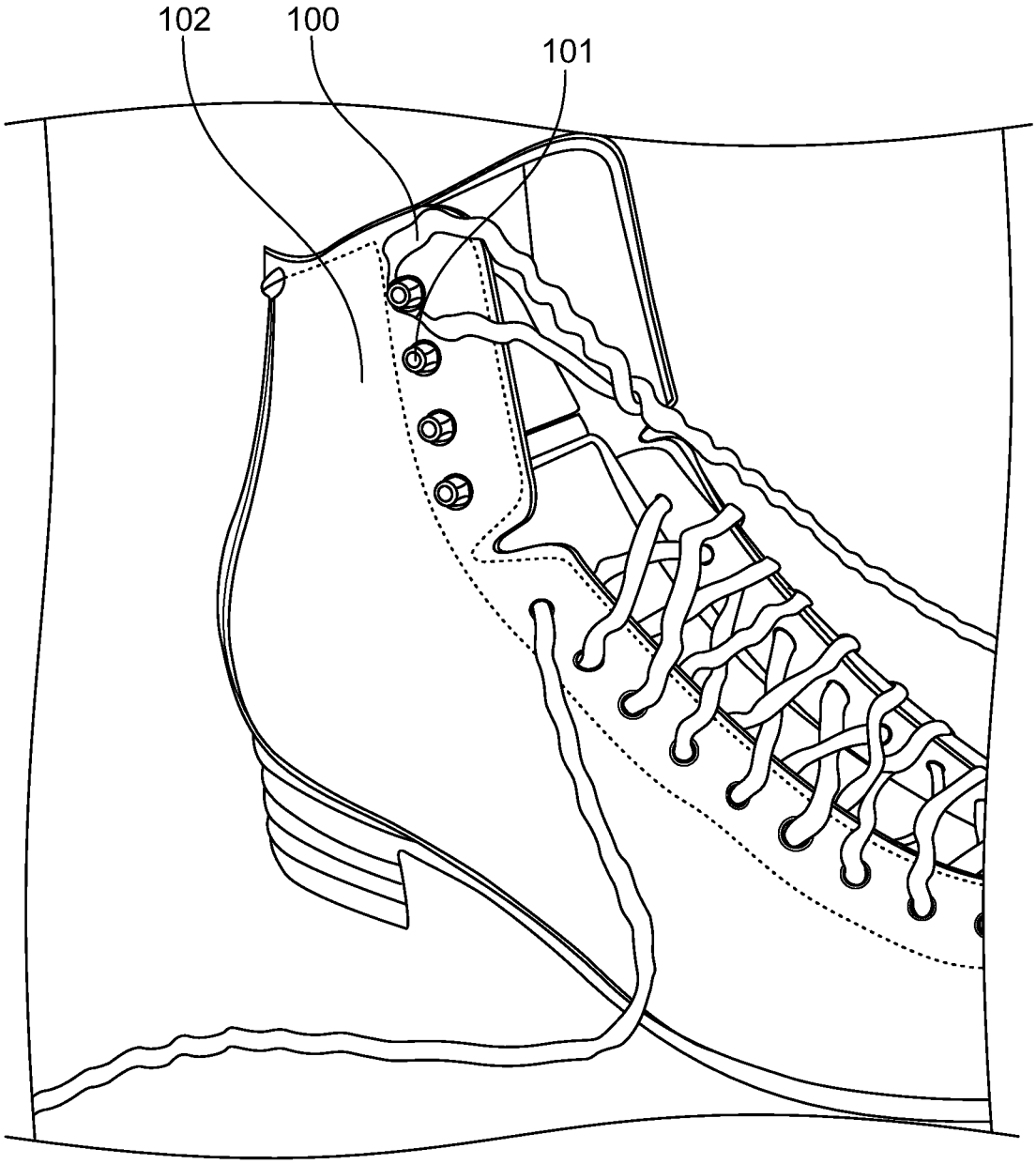

As shown on FIG. 13, after the lace is locked on the hook, the lace is still maintained on the hook after the user releases the lace.

As described above, the lace can hook at the eyelets and hooks, and the degree of the hooking can vary depending on the diameter of the eyelets and hooks, but also on the shape of the lace surface and its stiffness. Specifically, when pulling on the lace and trying to unlock the lace from the eyelet, the lace will stretch and its diameter will decrease (stretched position). As the transition between the concave and convex portions of the lace gets smoother (less distance between peak and trough), the lace body will eventually pass through the eyelets of the shoe. As the concave and convex portions are stretched and get narrower, the diameter of the lace body is reduced. When no more tension is applied on the lace (e.g. the lace is relaxed and it returns to its original and rest position or state i.e. greater distance between peak and trough) the diameter of the concave and convex portions relatively becomes greater, and it becomes difficult to unhook the lace once it is hooked at a hook of a shoe or a eyelet. It also becomes more difficult to make the lace pass through the eyelets unless a significant tension in the longitudinal and axial direction is applied on the lace to stretch it.

Figure 14A:
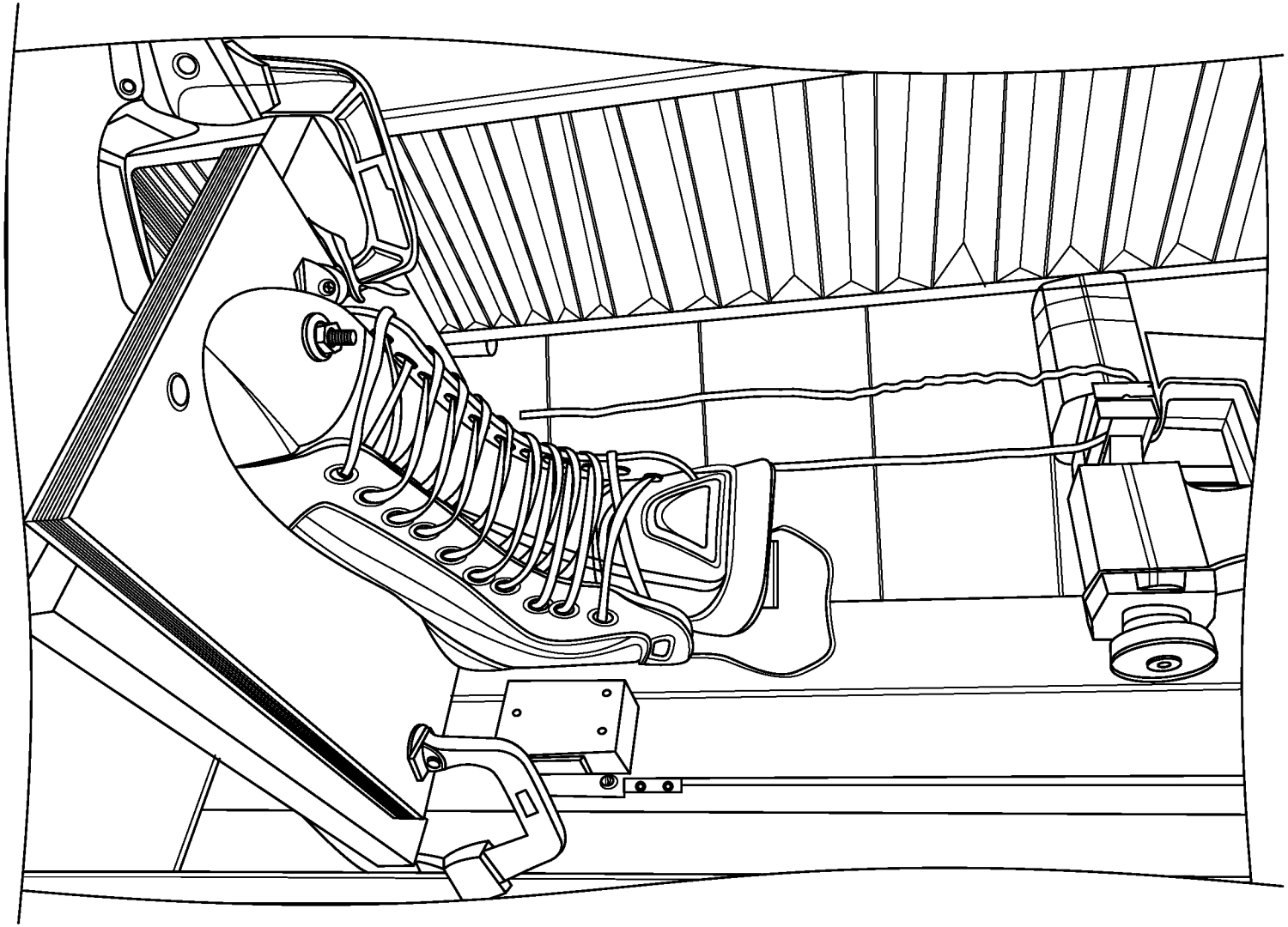
FIGS. 14A and 14B show a perspective view of an experimental setup for evaluating the resistance of the LACE according to one of the embodiments described herein and a typical hockey skate lace, respectively, against sliding.
Figure 14B:
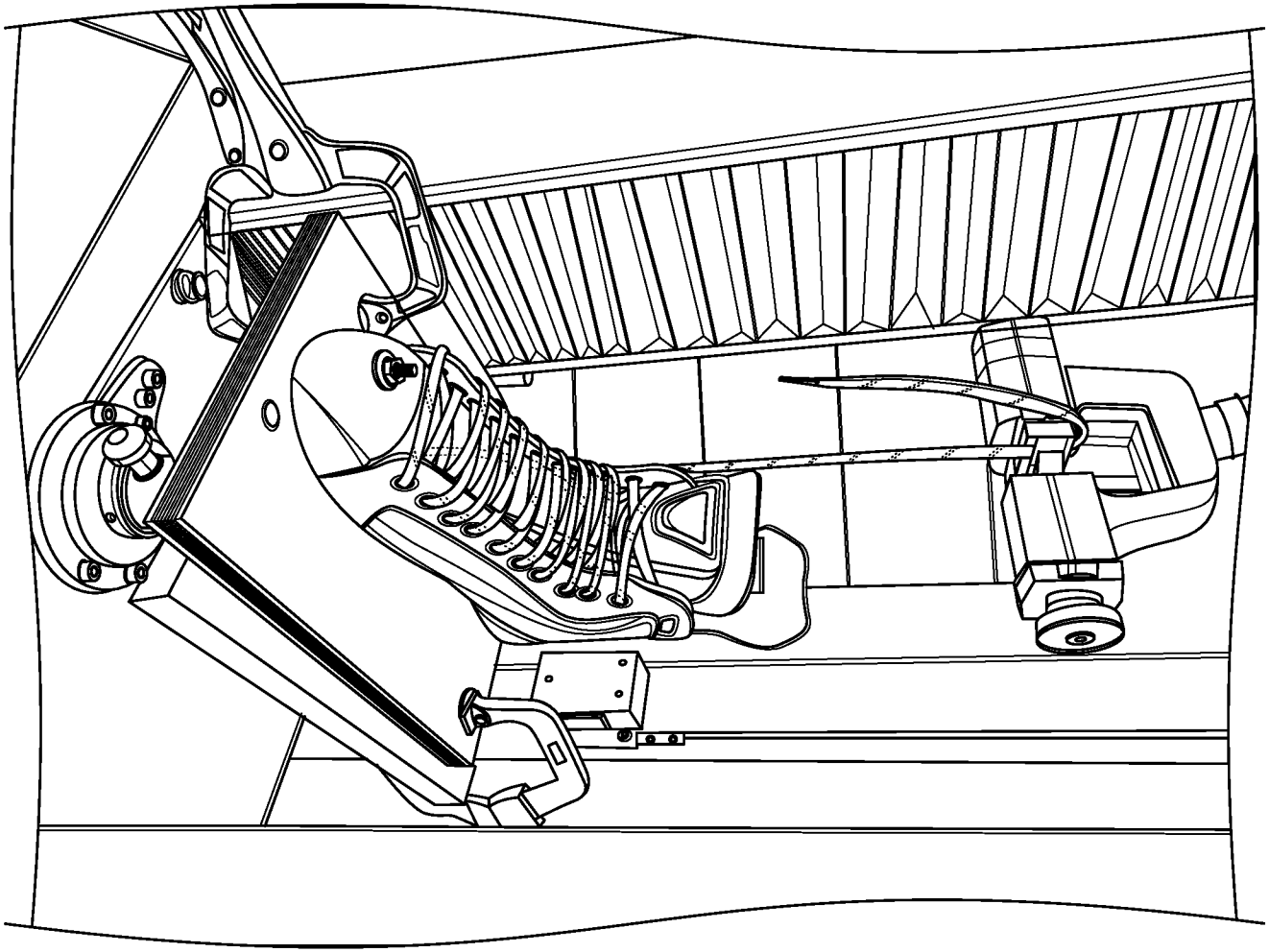
Figure 16:
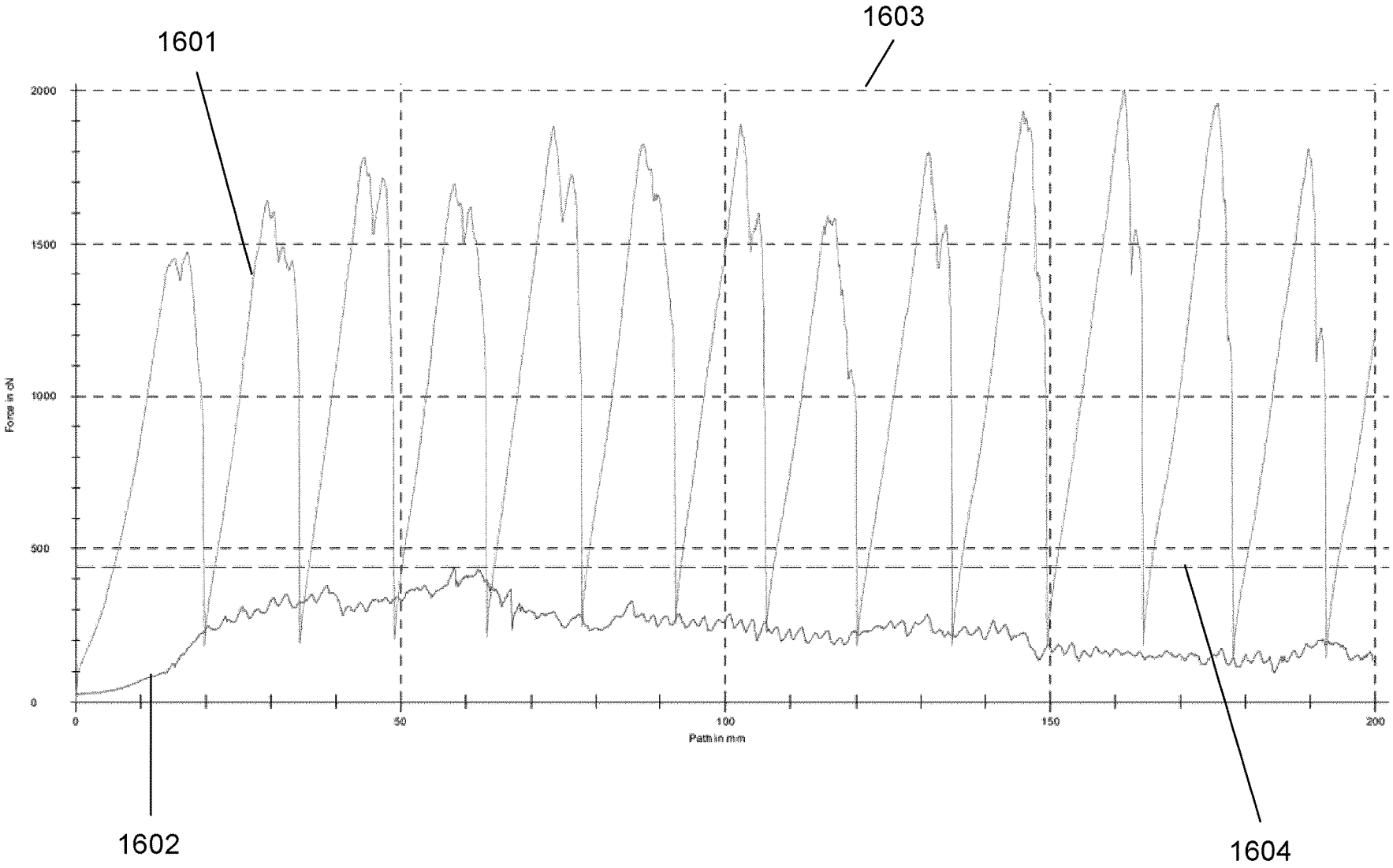
FIG. 16 shows a graph of force (cN) versus path (mm) for evaluating the resistance of the LACE according to one of the embodiments described herein and the typical hockey skate lace shown in FIGS. 14A and 14B, respectively, against sliding.

FIGS. 14A and 14B show an experimental setup for evaluating the sliding behavior of a lace according to an embodiment described herein and a typical hockey skate lace currently available on the market, respectively, when the laces are used on a hockey skate. In this example, the lace according to an embodiment described herein has a thickness of about 4.5 mm and a width of about 4.5 mm and the typical hockey skate lace currently available on the market has a thickness of about 10 mm and a width of about 1 mm. Each eyelet of the hockey skate has a diameter of about 6 mm. The results of this experiment are shown in FIG. 16.

Figure 15A:
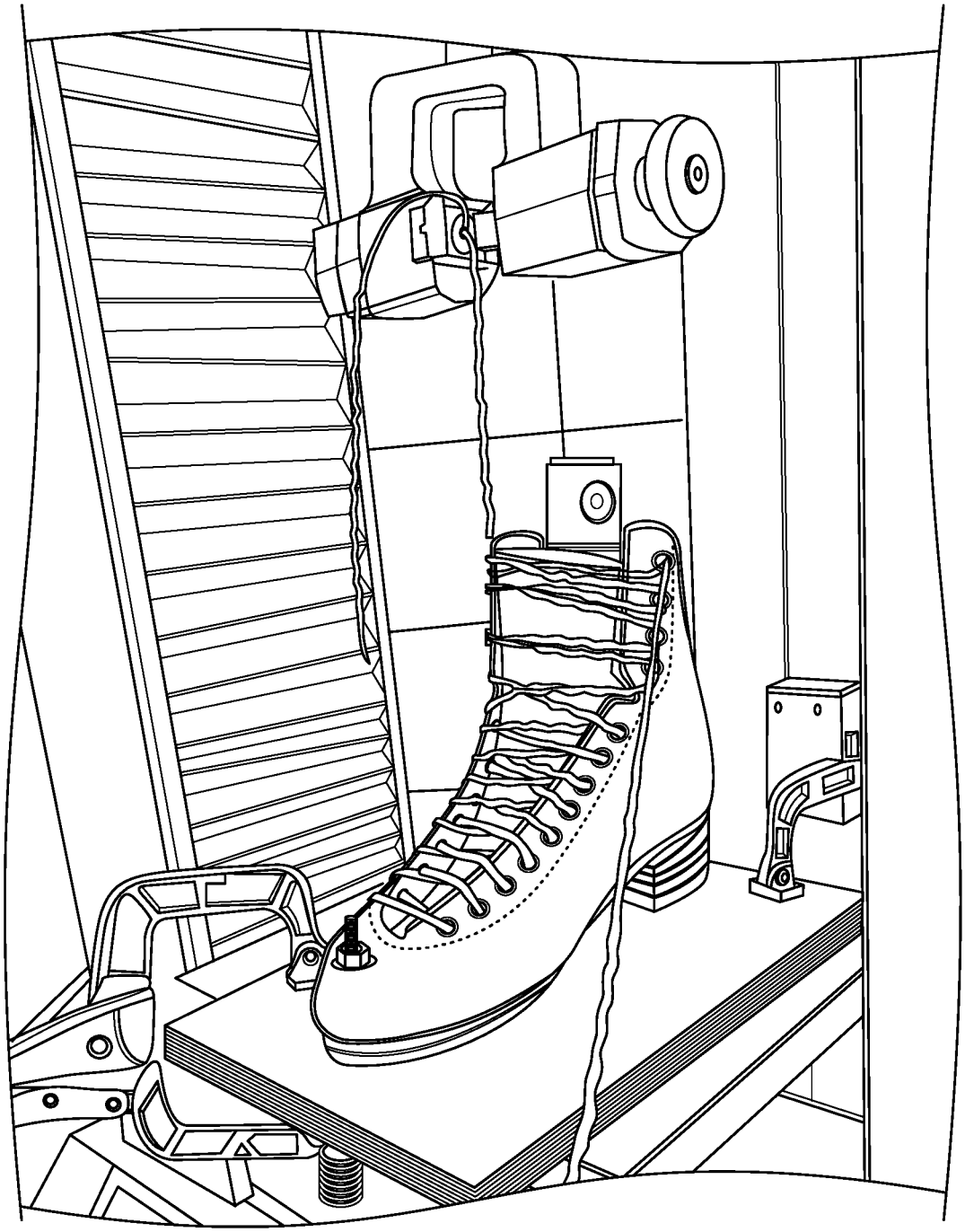
FIGS. 15A and 15B show a perspective view of an experimental setup for evaluating the resistance of the LACE according to one of the embodiments described herein and a typical artistic skate lace, respectively, against sliding.
Figure 15B:
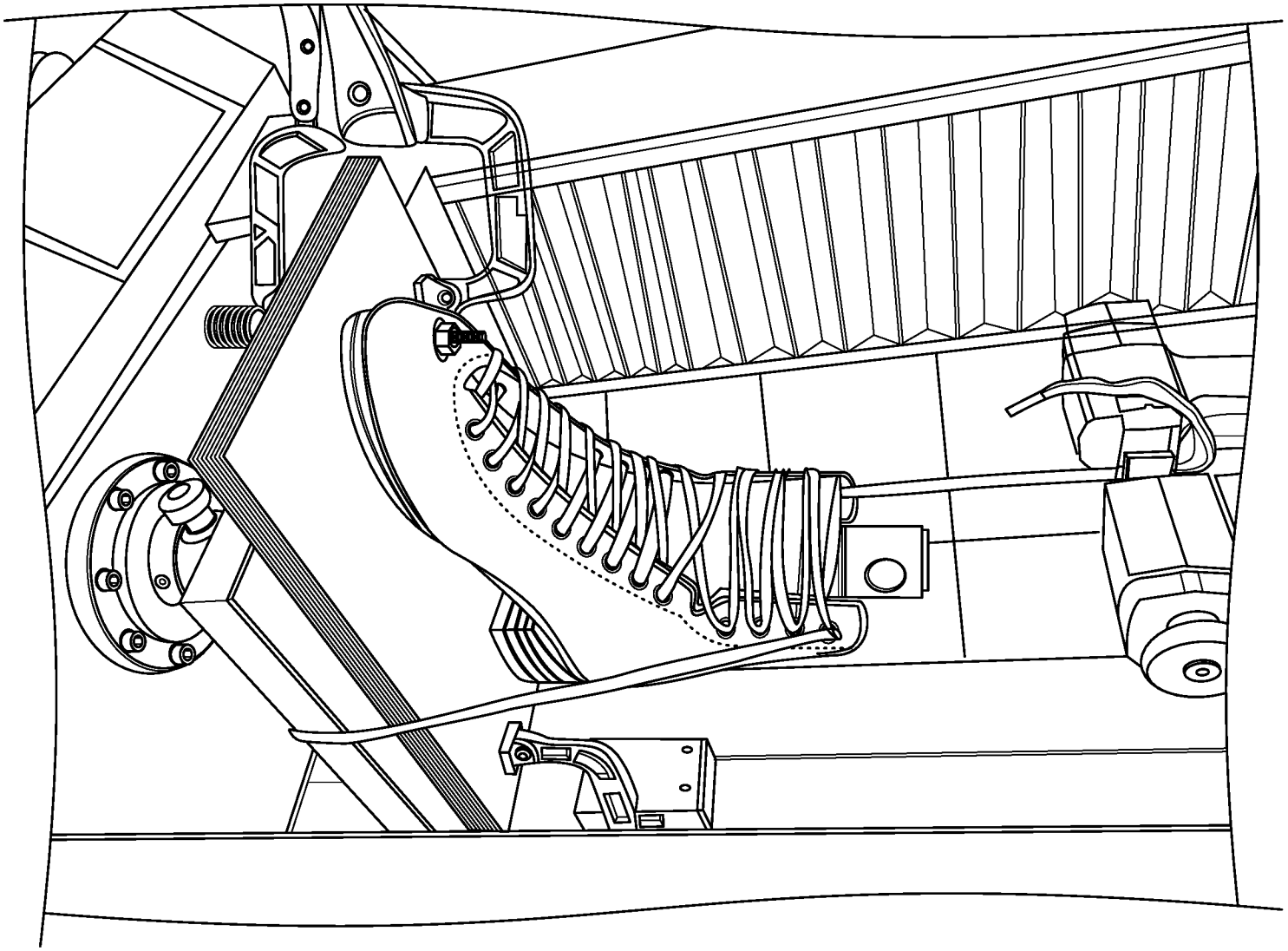
Figure 17:
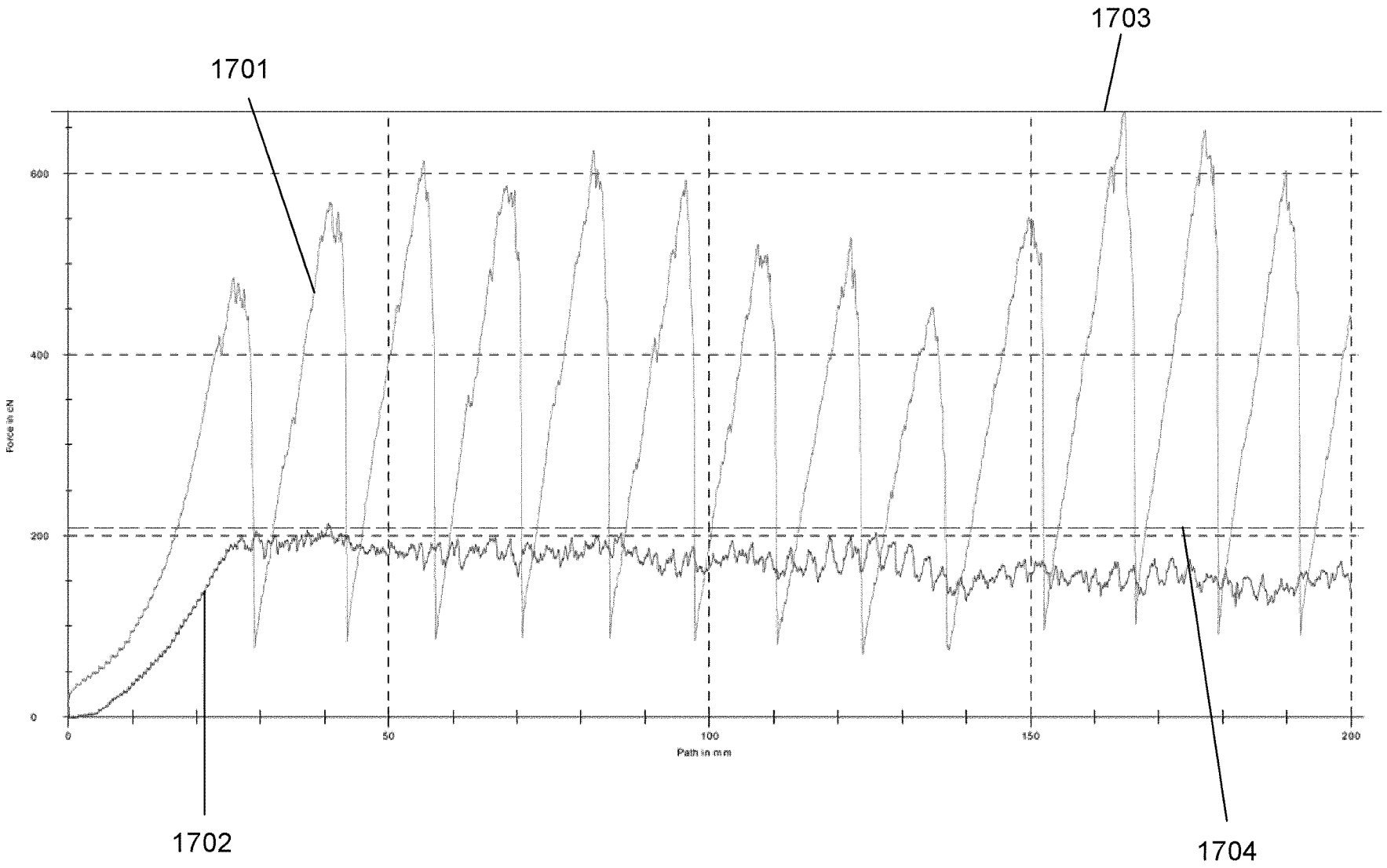
FIG. 17 shows a graph of force (cN) versus path (mm) for evaluating the resistance of the LACE according to one of the embodiments described herein and a typical artistic skate lace shown in FIGS. 15A and 15B, respectively, against sliding.

Similarly, FIGS. 15A and 15B show an experimental setup for evaluating the sliding behavior of a lace according to an embodiment described herein and a typical artistic skate lace currently available on the market, respectively, when the laces are used on an artistic skate. In this example, the lace according to an embodiment described herein has a thickness of about 4.5 mm and a width of about 4.5 mm and the typical artistic skate lace currently available on the market has a thickness of about 6.5 mm and a width of about 1 mm. Each eyelet of the artistic skate has a diameter of about 3 mm. The results of this experiment are shown in FIG. 17.

Figure 18:
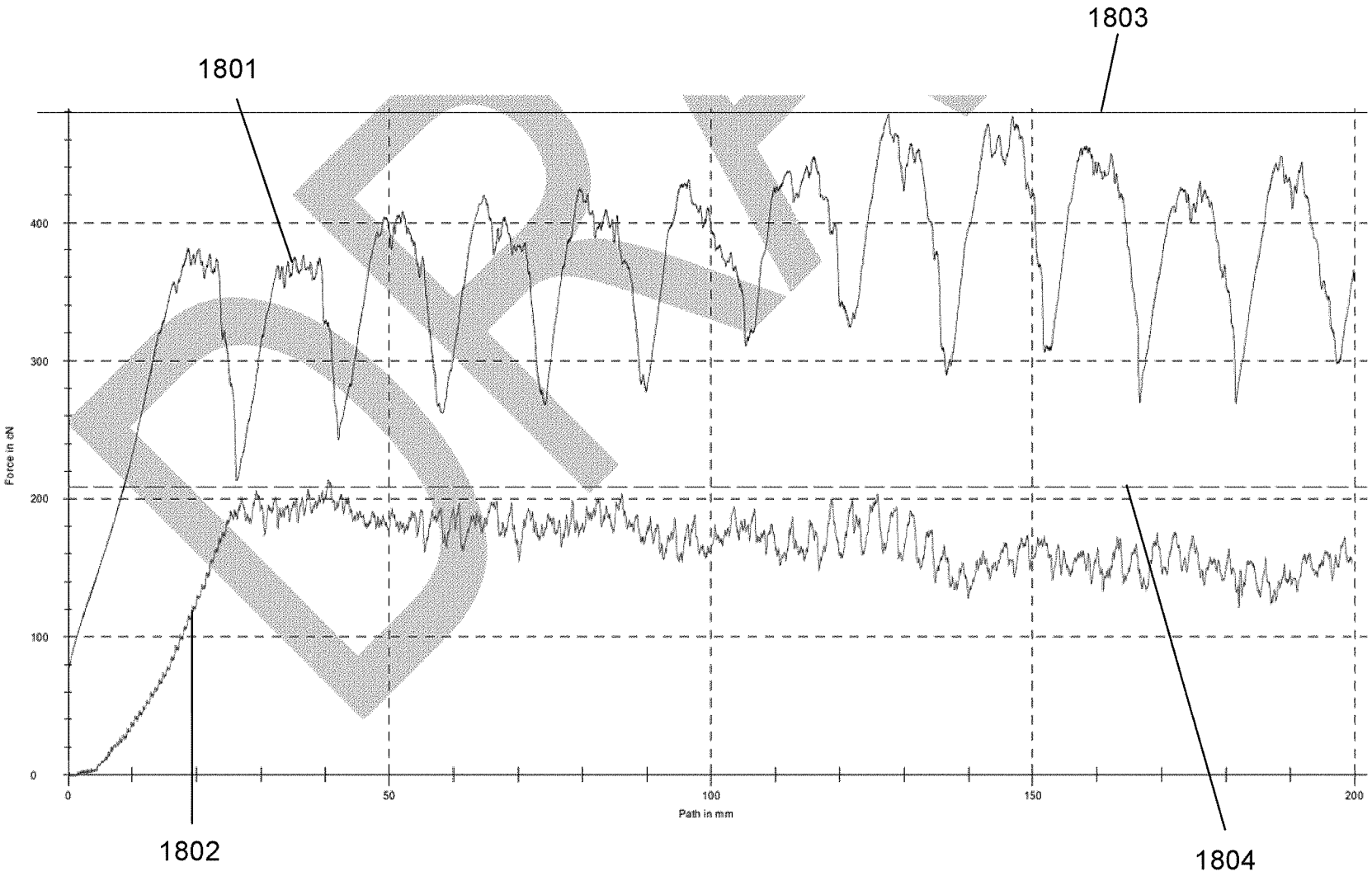
FIG. 18 shows a graph of force (cN) versus path (mm) for evaluating the resistance of the LACE according to another one of the embodiments described herein and a typical artistic skate lace shown FIG. 19, against sliding.

The sliding behavior of a lace according to another embodiment described herein was also compared to a typical artistic skate lace currently available on the market when the laces are used on an artistic skate. In this example, the lace according to an embodiment described herein has a thickness of about 3.8 mm and a width of about 3.8 mm and the typical artistic skate lace currently available on the market has a thickness of about 6.5 mm and a width of about 1 mm. Each eyelet of the artistic skate has a diameter of about 3 mm. The results of this experiment are shown in FIG. 18.

To evaluate the resistance of each of the laces in the experiments described above, each skate was mounted and fixed on a tensile apparatus, as shown in FIGS. 14A to 15B. Subsequently, each lace was stretched upwardly at a speed of 100 mm/min to a maximum force where the lace began to slide through the uppermost eyelet hole of the skate. Then, the lace was released and stretched again to a maximum force where the lace began to slide through the uppermost eyelet hole of the skate. The test was performed for a number of cycles for each skate.

FIG. 16 shows the results of evaluating the sliding behavior of a lace according to an embodiment described herein and a typical lace currently available on the market, respectively, when the laces are used on a hockey skate. In FIG. 15, line 1601 represents the force tolerated by the lace according to an embodiment described herein along a path length of the lace as the lace was pulled through an eyelet of the hockey skate. In other words, the force required to disengage the lace from an eyelet of the hockey skate and slide the lace therethrough is shown in FIG. 16. For example, the lace resisted sliding through an eyelet of a hockey skate when the lace was passed through the eyelet of the hockey skate and a vertical force of about 5 N was applied to the lace. For example, the lace resisted sliding through an eyelet of a hockey skate when the lace was passed through the eyelet of the hockey skate and a vertical force of about 7.5 N was applied to the lace. For example, the lace resisted sliding through an eyelet of a hockey skate when the lace was passed through the eyelet of the hockey skate and a vertical force of about 10 N was applied to the lace. For example, the lace resisted sliding through an eyelet of a hockey skate when the lace was passed through the eyelet of the hockey skate and a vertical force of about 13 N was applied to the lace.

Maximum line 1603 shows that the maximum force required to pull the lace through eyelet over the path tested was about 20 N.

Line 1602 represents the force tolerated by the lace currently available on the market along a path length of the lace as the lace was pulled through an eyelet of the hockey skate. Maximum line 1604 shows that the maximum force required to pull the lace through eyelet over the path tested was about 4.5 N.

To further compare the lace according to an embodiment described herein to the lace currently on the market, an average maximum force was calculated for each of the laces as an average of each of the peaks on the lines 1601 and 1602. The average maximum force of line 1601 is 17.14 N and the average maximum force of line 1602 is 4.40 N. Accordingly, when compared to the lace currently on the market, the lace according to an embodiment described herein resists against higher forces before sliding, when used on a hockey skate. For instance, the lace according to an embodiment described herein tolerates about 390% higher force before sliding compared to the lace currently on the market. In other words, the lace according to an embodiment of the present disclosure tolerates a higher force before sliding i.e. it tolerates a 390% higher force than a standard hockey skate lace before sliding and being disengaged from the eyelet of the skate.

FIG. 17 shows the results of the first experiment described above evaluating the sliding behavior of a lace according to an embodiment described herein (i.e. having a thickness and a width of about 4.5 mm) and a typical lace currently available on the market, respectively, when the laces are used on an artistic skate. In FIG. 17, line 1701 represents the force tolerated by the lace according to an embodiment described herein (i.e. having a thickness and a width of about 4.5 mm) along a path length of the lace as the lace was pulled through an eyelet of the artistic skate. In other words, the force required to disengage the lace from an eyelet of the artistic skate and slide the lace therethrough is shown in FIG. 17. For example, the lace resisted sliding through an eyelet of the artistic skate when the lace was passed through the eyelet of the artistic skate and a vertical force of about 2.5 N was applied to the lace. For example, the lace resisted sliding through the eyelet of a artistic skate when the lace was passed through the eyelet of the artistic skate and a vertical force of about 3 N was applied to the lace. For example, the lace resisted sliding through an eyelet of a artistic skate when the lace was passed through the eyelet of the artistic skate and a vertical force of about 3.5 N was applied to the lace. For example, the lace resisted sliding through an eyelet of a artistic skate when the lace was passed through the eyelet of the artistic skate and a vertical force of about 4 N was applied to the lace.

Maximum line 1703 shows that the maximum force required to pull the lace according to an embodiment described herein (i.e. having a thickness and a width of about 4.5 mm) through eyelet over the path tested was about 6.7 N.

Line 1702 represents the force tolerated by the lace currently available on the market along a path length of the lace as the lace was pulled through an eyelet of the artistic skate. Maximum line 1704 shows that the maximum force required to pull the lace currently available on the market through eyelet over the path tested was about 2.1 N.

Again, to further compare the lace according to an embodiment described herein to the lace currently on the market, an average maximum force was calculated for each of the laces as an average of each of the peaks on the lines 1701 and 1702. The average maximum force of line 1701 is 5.73 N and the maximum force average of line 1702 is 2.08 N. Accordingly, when compared to the lace currently on the market, the lace according to an embodiment described herein (i.e. having a thickness and a width of about 4.5 mm) resists against higher forces before sliding, when used on an artistic skate. For instance, the lace according to an embodiment described herein (i.e. having a thickness and a width of about 4.5 mm) tolerates about 275% higher force before sliding compared to the lace currently on the market.

Figure 19:
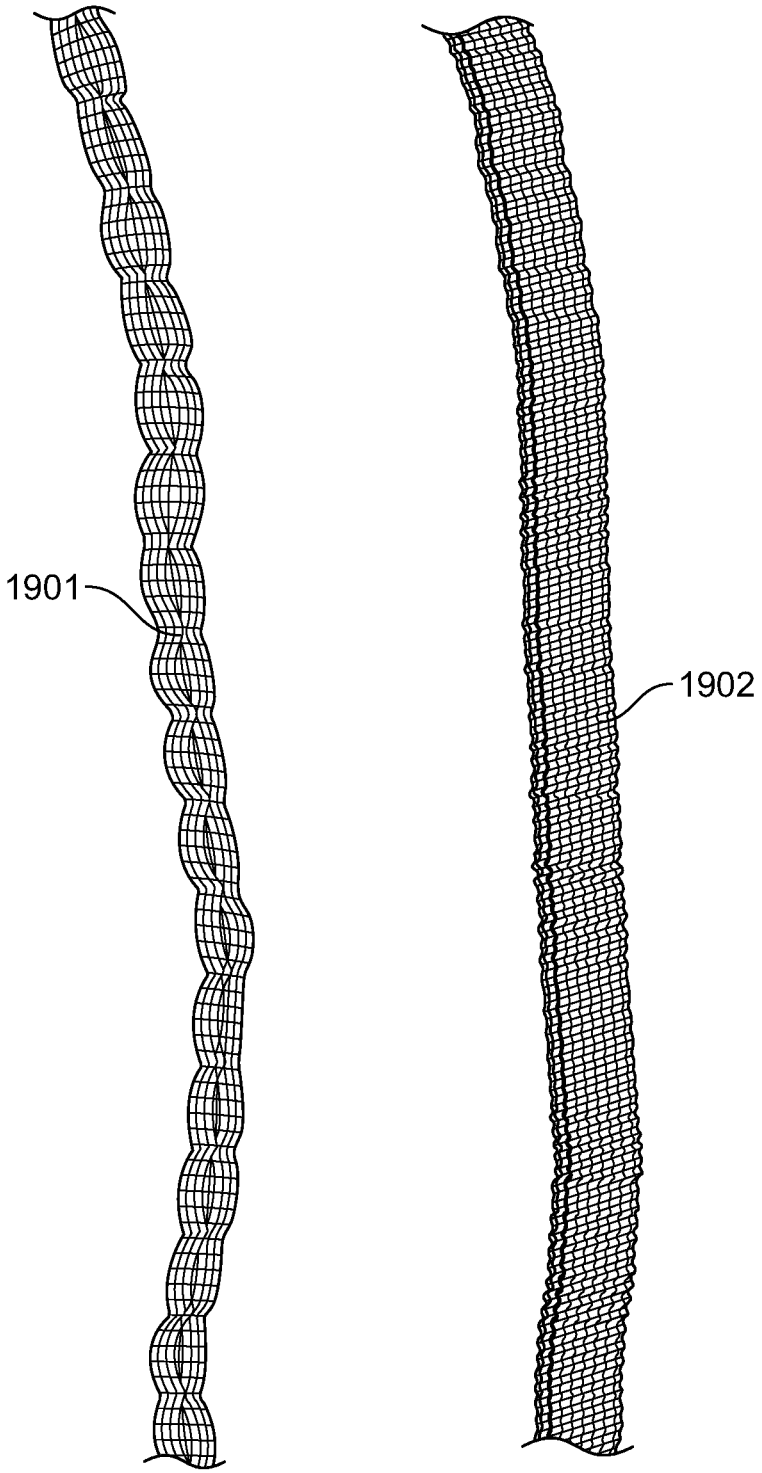
FIG. 19 shows a perspective view of a LACE according to one of the embodiments described herein and a typical artistic skate lace used in the second experiment evaluating resistance against sliding, the results of which are shown in FIG. 18.

FIG. 18 shows the results of the second experiment described above evaluating the sliding behavior of a lace according to an embodiment described herein (i.e. having a thickness and a width of about 3.8 mm) and the typical lace currently available on the market, respectively, when the laces are used on an artistic skate. The lace according to an embodiment described herein 1901 and the typical lace currently available on the market 1902 that were tested in the second experiment are shown in FIG. 19. In FIG. 18, line 1801 represents the force tolerated by the lace according to an embodiment described herein (i.e. having a thickness and a width of about 3.8 mm) along a path length of the lace as the lace was pulled through an eyelet of the artistic skate. In other words, the force required to disengage the lace from an eyelet of the artistic skate and slide the lace therethrough is shown in FIG. 18. For example, the lace resisted sliding through an eyelet of the artistic skate when the lace was passed through the eyelet of the artistic skate and a vertical force of about 2.5 N was applied to the lace. For example, the lace resisted sliding through an eyelet of a hockey skate when the lace was passed through the eyelet of the hockey skate and a vertical force of about 3 N was applied to the lace. For example, the lace resisted sliding through an eyelet of a hockey skate when the lace was passed through the eyelet of the hockey skate and a vertical force of about 3.5 N was applied to the lace. For example, the lace resisted sliding through an eyelet of a hockey skate when the lace was passed through the eyelet of the hockey skate and a vertical force of about 4 N was applied to the lace.

Maximum line 1803 shows that the maximum force required to pull the lace through eyelet over the path tested was about 4.8 N.

Line 1802 represents the force tolerated by the lace currently available on the market along a path length of the lace as the lace was pulled through an eyelet of the artistic skate. Maximum line 1804 shows that the maximum force required to pull the lace through eyelet over the path tested was about 2.1 N.

Again, to further compare the lace according to an embodiment described herein (i.e. having a thickness and a width of about 3.8 mm) to the lace currently on the market, an average maximum force was calculated for each of the laces as an average of each of the peaks on the lines 1801 and 1802. The average maximum force of line 1801 is 4.32 N and the maximum force average of line 1802 is 2.08 N. Accordingly, when compared to the lace currently on the market, the lace according to an embodiment described herein (i.e. having a thickness and a width of about 3.8 mm) resists against higher forces before sliding, when used on an artistic skate. For instance, the lace according to an embodiment described herein tolerates about 208% higher force before sliding compared to the lace currently on the market.

The embodiments of the paragraphs of the present disclosure are presented in such a manner in the present disclosure so as to demonstrate that every combination of embodiments, when applicable can be made. These embodiments have thus been presented in the description in a manner equivalent to making dependent claims for all the embodiments that depend upon any of the preceding claims (covering the previously presented embodiments), thereby demonstrating that they can be combined together in all possible manners. For example, all the possible combination, when applicable, between the embodiments of any paragraphs and the devices, laces, footwear, and kits of the SUMMARY OF THE DISCLOSURE are hereby covered by the present disclosure.

The present disclosure has been described with regard to specific examples. The description was intended to help the understanding of the disclosure, rather than to limit its scope. It will be apparent to one skilled in the art that various modifications can be made to the disclosure without departing from the scope of the disclosure as described herein, and such modifications are intended to be covered by the present document.

The invention claimed is:

1. A lace, comprising:

a structure of elastic material, the structure having at least two pairs of opposite sides;

a first pair of the opposite sides in which:

a first side of the first pair comprises alternating concave and convex portions;

a second side of the first pair comprises alternating concave and convex portions;

wherein the concave portions of the first side of the first pair match with the convex portions of the second side of the first pair along a longitudinal axis;

wherein the convex portions of the first side of the first pair match with the concave portions of the second side of the first pair along the longitudinal axis;

a second pair of the opposite sides in which:

a first side of the second pair comprises alternating concave and convex portions;

a second side of the second pair comprises alternating concave and convex portions;

wherein the concave portions of the first side of the second pair match with the concave portions of the second side of the second pair along the longitudinal axis; and wherein the convex portions of the first side of the second pair match with the convex portions of the second side of the second pair along the longitudinal axis.

2. The lace of claim 1, wherein each of the concave portions of each of the at least two pairs of opposite sides form cavities, the cavities being effective for abutting against eyelets or hooks found in skates and effective to lock the lace at a given position when the lace is inserted into the eyelets or hooks.

3. The lace of claim 1, wherein the elastic material is braided.

4. The lace of claim 1, wherein the at least two pairs of opposite sides are a single unitary continuous piece.

5. The lace of claim 1, wherein the first pair of opposite sides is substantially orthogonal to the second pair of opposite sides.

6. The lace of claim 1, wherein a distance between a peak of the convex portions and a trough of the concave portions of the first pair is greater than the distance between a peak point of the convex portions and a trough of the concave portions of the second pair.

7. The lace of claim 1, wherein a distance between a peak of the convex portions and a trough of the concave portions of the first pair is at least two times greater than a distance between the peak of convex portions and a trough of the concave portions of the second pair.

8. The lace of claim 1, wherein the lace has a thickness of about 3.5 mm to about 5 mm.

9. The lace of claim 8, wherein a force in a range of about 5 to about 25 N is necessary to disengage the lace from an eyelet of a hockey skate and slide the lace therethrough.

10. The lace of claim 8, wherein a force in a range of about 10 to about 25 N is necessary to disengage the lace from an eyelet of a hockey skate and slide the lace therethrough.

11. The lace of claim 8, wherein a force in a range of about 200% to about 400% greater than a force to disengage a standard lace is necessary to disengage the lace from an eyelet of a hockey skate and slide the lace therethrough.

12. The lace of claim 1, wherein the lace has a drape stiffness of about 5.8 cm to about 6.6 cm in accordance with FTMS 191A Method 5206.

13. The lace of claim 1, wherein the lace has a tex yarn of about 7 000 tex to 14 000 tex in accordance with CAN/CGSB-4.2 No 5.2-M87 (2013) standard.

14. The lace of claim 1, wherein the lace has a denier yarn of about 60 000 denier to about 130 000 denier in accordance with CAN/CGSB-4.2 No 5.2-M87 (2013) standard.

15. The lace of claim 1, wherein a force of at least 5 N is necessary to disengage the lace from an eyelet of a hockey skate and slide the lace therethrough.

16. The lace of claim 1, wherein a force in a range of about 2.5 to about 10 N is necessary to disengage the lace from an eyelet of an artistic skate and slide the lace therethrough.

17. The lace of claim 1, wherein a force in a range of about 100% to about 300% greater than a force to disengage a standard lace is necessary to disengage the lace from an eyelet of an artistic skate and slide the lace therethrough.

18. The lace of claim 1 for use in combination with a skate having eyelets with a diameter of about 2.5 mm to about 3.5 mm.

19. The lace of claim 1 for use in combination with a skate having eyelets with a diameter of about 5.5 mm to about 6.5 mm.

20. The lace of claim 1, wherein the lace width is measured between two most distant points on an axis that is orthogonal to an axis that is defined by the lace and extending along a length of the lace.

21. The lace of claim 1, wherein the lace thickness is measured between two most distant points on an axis that is orthogonal to an axis that is defined by the lace and extending along a length of the lace.

* * * * *